United States Patent [19]

Luedtke

[11] 4,278,187

[45] Jul. 14, 1981

[54] TRIGGER LOCK SYSTEM FOR PUMP

[75] Inventor: Warren J. Luedtke, Fish Creek, Wis.

[73] Assignee: Security Plastics, Inc., Miami Lakes, Fla.

[21] Appl. No.: 103,363

[22] Filed: Dec. 13, 1979

[51] Int. Cl.[3] ..... B67B 5/00

[52] U.S. Cl. ..... 222/153; 222/321; 222/384

[58] Field of Search ..... 222/153, 321, 383, 384, 222/385; 239/333, 375, 359

[56] References Cited

U.S. PATENT DOCUMENTS

| | | | |
|---|---|---|---|
| 3,927,834 | 12/1975 | Tada | 239/359 |
| 4,220,285 | 9/1980 | Gualdi | 239/333 |

*Primary Examiner*—Allen N. Knowles

*Attorney, Agent, or Firm*—Oltman and Flynn

[57] ABSTRACT

A pumping assembly for dispensing product from a container is provided with a lever having a catch which locks with a lip on a closure to hold the lever in a depressed position.

6 Claims, 11 Drawing Figures

FIG. 6
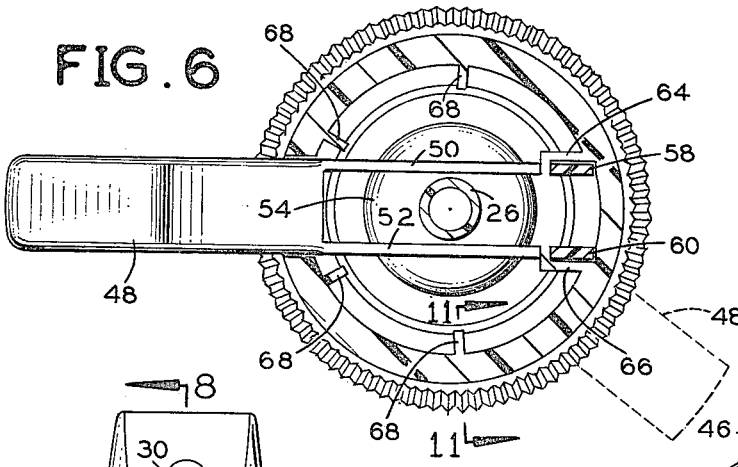
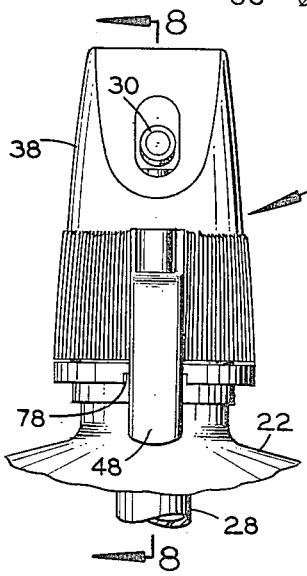
FIG. 7
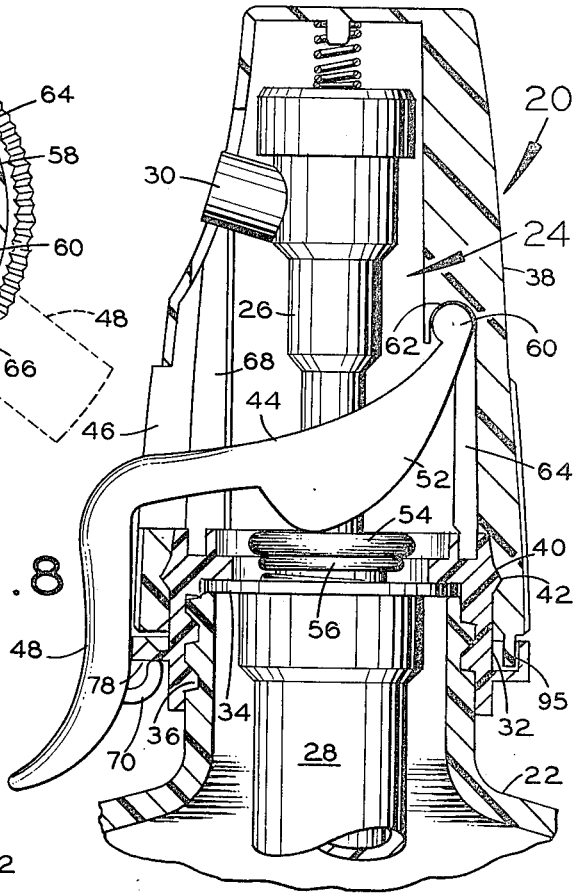
FIG. 8
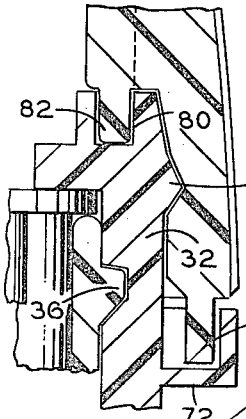
FIG. 11
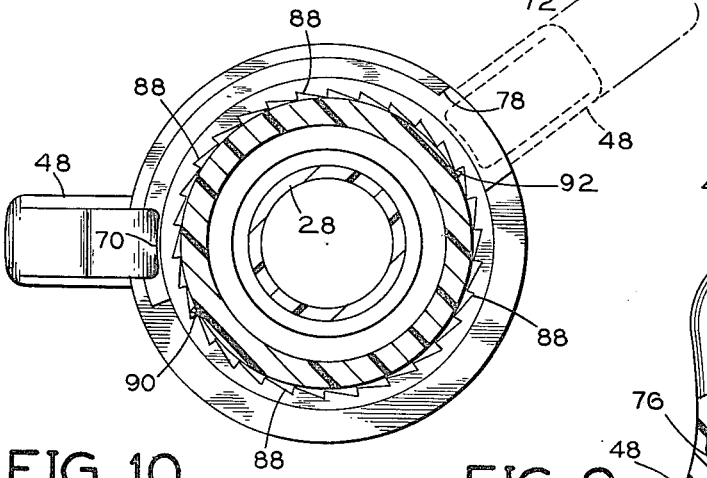
FIG. 10
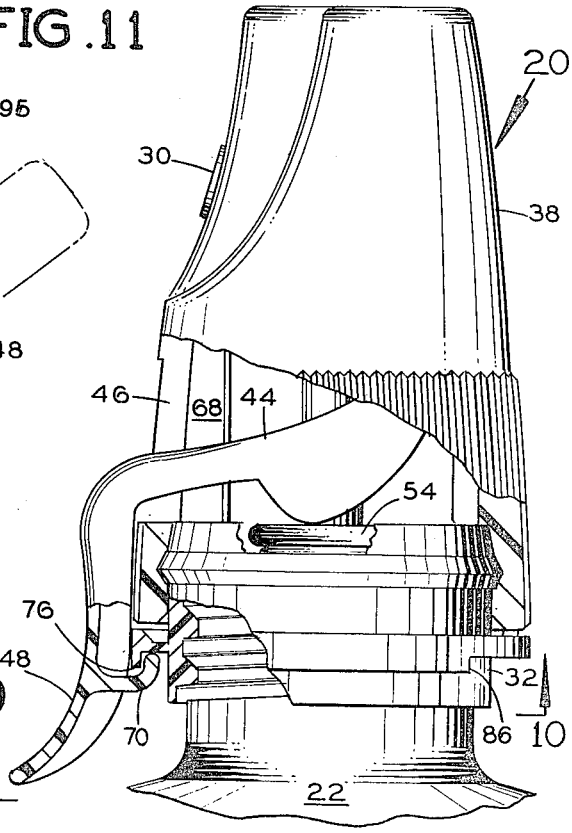
FIG. 9

TRIGGER LOCK SYSTEM FOR PUMP

BACKGROUND OF THE INVENTION

A continuous trigger activated pumping system is described and claimed in U.S. Pat. No. 4,146,155 of Louis F. Kutik and Howard E. Cecil assigned to the present assignee. In that pumping system, the trigger is an outer portion of a lever which actuates piston and cylinder devices to discharge product in a relatively continuous stream or spray. The outwardly projecting trigger in such a pump involves some problems. During shipping, it requires excess carton space and may get hung up on carton dividers. It may also be in the way of capping machinery when gripping the upper housing of the pump assembly to screw the closure of the assembly on the container. Also, it would be desirable to be able to lock the upper housing and the closure tightly together so that they may be handled as a single unit in the capping operation. Furthermore, it would be desirable to inhibit users such as children from operating the lever when the product is stored on market shelves.

SUMMARY OF THE INVENTION

The present invention provides a dispensing pump assembly in which a pivotally reciprocal lever for actuating the pump assembly is provided with a catch, and a closure for the pump assembly is provided with a locking device for releasably engaging the catch to lock the lever in a depressed position. The lock is preferably an annular lip on the closure with a recess therein for allowing the catch to be inserted in the recess and rotated to engage the lip. The lock will hold the entire assembly together for easier handling and assembly with the container. The lever is tucked in so that it does not get hung up on carton dividers when the pump assembly is packaged in cartons. With the lever locked down, considerably more upper housing area is available for capping machinery to grip. It is more difficult for children to play with the pump when the unit is standing on market shelves with the lever locked down.

Accordingly, it is an object of the present invention to provide a trigger locking system for a pump assembly in which a lever providing a trigger may be locked to a closure of the assembly for holding the trigger in a depressed position.

Another object of the invention is to lock an upper housing of a pump assembly to a closure of the pump assembly so that the assembly may be handled as a unit.

Another object of the invention is to lock a trigger of a pump assembly in a depressed condition to inhibit tampering with the lever.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 6 is a horizontal sectional view taken along line 6—6 of FIG. 2;

FIG. 7 is an elevational view similar to FIG. 1, but showing the lever of the pumping system in a depressed condition;

FIG. 8 is a vertical sectional view taken along line 8—8 of FIG. 7;

FIG. 9 is a vertical sectional view similar to FIG. 8, but showing the lever and housing of the pump assembly rotated to lock the lever with the closure of the assembly;

FIG. 10 is a horizontal sectional view taken along line 10—10 of FIG. 9; and

FIG. 11 is a fragmentary sectional view taken along line 11—11 of FIG. 6.

Figure 1:
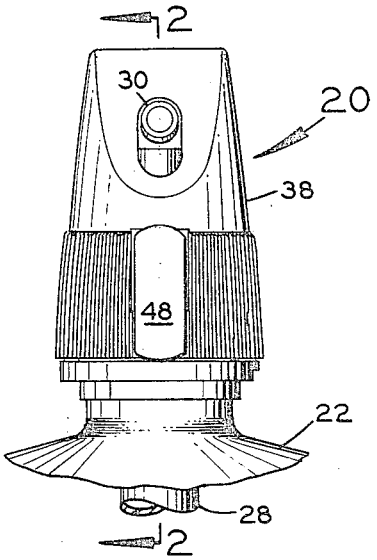
FIG. 1 is an elevational view of a pump assembly provided with a trigger locking system in accordance with one embodiment of the invention.
Figure 2:
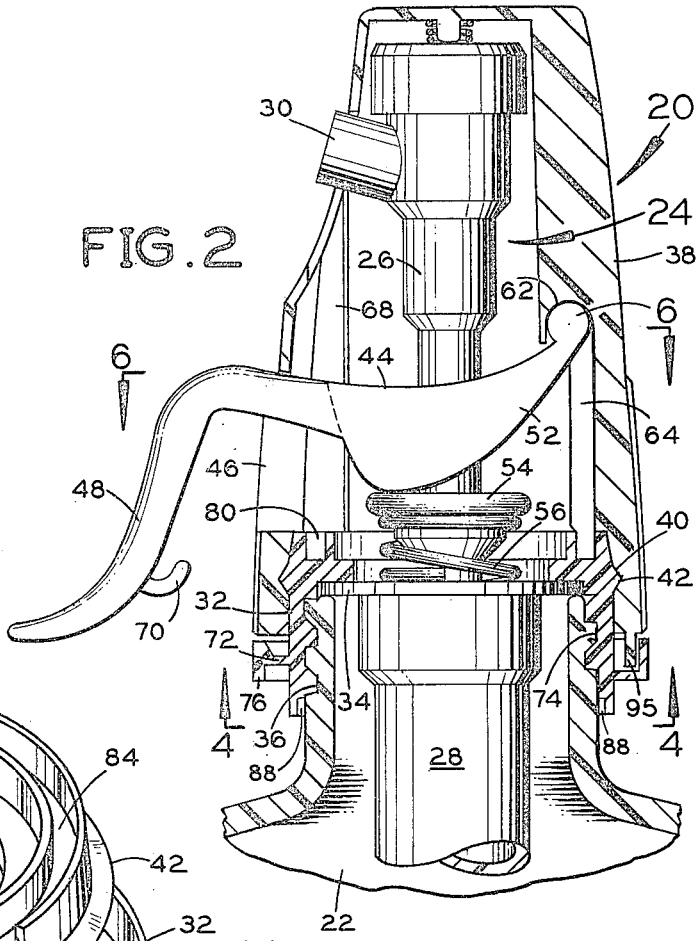
FIG. 2 is a vertical sectional view taken along line 2—2 of FIG. 1.
Figure 5:
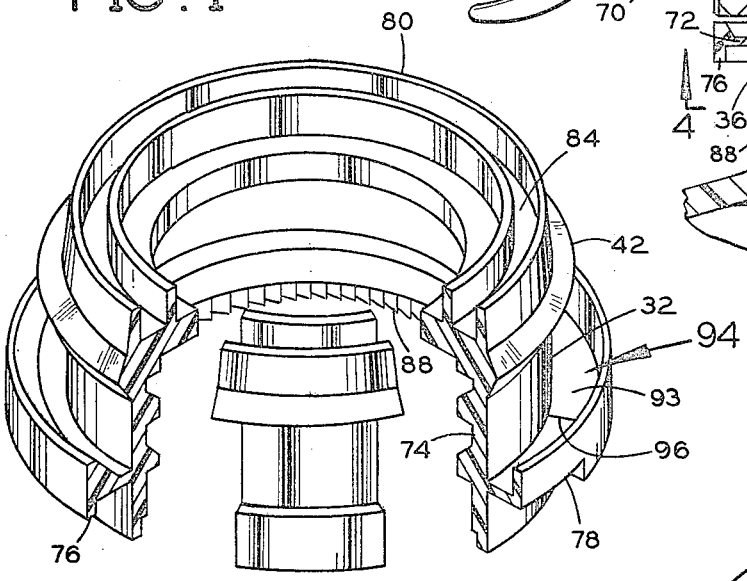
FIG. 5 is a perspective view, partially cut away, showing a closure ring included in the assembly.
Figure 3:
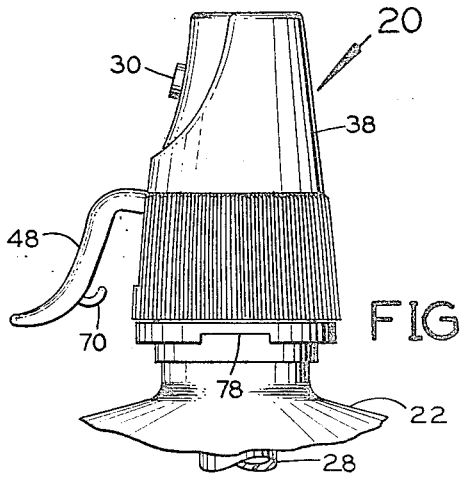
FIG. 3 is an elevational view of the pump assembly taken from the right side in FIG. 1.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The pump assembly 20 is attached to a container 22 and serves to dispense product from the container as a relatively continuous stream or spray. The pump unit 24 of the assembly is a piston and cylinder device in which a piston 26 is reciprocable in a cylinder 28 for withdrawing product from the container 22 and discharging the product as a stream or spray through an orifice at 30. The pump unit 24 may be substantially the same as the pump unit disclosed in the aforementioned U.S. Pat. No. 4,146,155, and therefore, the disclosure of said patent is incorporated herein by reference.

The pump assembly 20 includes a closure ring 32 in which an upper flange 34 of the cylinder 28 is received. The flange 34 may be snapped into the ring 32, or the cylinder 28 and the ring 32 may be molded integrally with each other as a single unit if desired. The closure 32 has internal threads 36 which screw onto external threads on the neck of the container 22.

An upper housing 38 covers the protruding piston 26 of the pump unit 24. The upper housing 38 has a recess 40 that snaps on to a protrusion 42 on the closure 32 for securing the housing 38 to the closure 32. The housing 38 is rotatable on the closure 32.

A lever 44 is pivotally connected to the housing 38. The lever 44 projects outwardly from the housing 38 through an opening 46, and the outer portion of the lever is turned downwardly to form a trigger 48. The inner end of the lever 44 includes spaced portions 50 and 52 (FIG. 6) which straddle the piston 26 and engage an enlargement 54 on the piston so that when the lever is depressed, the piston 26 will also be depressed. The piston is urged upwardly by a spring 56.

The inner ends of the spaced portions 50 and 52 have generally circular enlargements 58 and 60 that snap into a semicircular recess 62 formed in the wall of the upper housing 38. The recess 62 is located between ribs 64 and 66. There may be other ribs such as 68 formed on the inside of the housing. The enlarged tips 58 and 60 and the recess 62 constitute a pivot means for the lever 44.

On the inside face of the trigger 48, there is a hook-shaped catch 70 that cooperates with a lock on the closure 32. An annular lip 72 projects radially outward from the vertical wall 74 of the closure, and the lip has a generally circular downturned edge 76. The downturned edge 76 has a downwardly facing recess or notch 78 therein which receives the catch 70 in the manner shown in FIG. 8 when the lever 44 is aligned with the recess and then depressed. The housing 38 and the lever 44 may then be rotated to turn the catch 70 so that it engages the downturned lip 76 in the manner shown in FIG. 9. Thus, the housing and lever is first rotated to align the lever with the recess. The lever is then depressed to insert the catch 70 into the recess 78 as shown in FIG. 8. The housing and lever are then rotated further to engage the catch 70 with the downturned edge 76 of the lip 72.

The catch may be disengaged by simply reversing the foregoing steps.

The closure ring 32 has an upwardly facing annular recess 80 therein which receives a lug 82 on the lower end of at least one of the ribs 68. The bottom wall 93 of the recess 94 may have a shoulder 96 formed therein so that the lug 95 will engage the shoulder to stop the rotation of the housing 32 at a predetermined position. Similarly, the lip 72 has a shoulder 86 formed therein in a position to engage the catch 70 to stop rotation of the housing and lever. Thus, when the housing 38 is being twisted during a capping operation, the trigger will catch on the shoulder 86 so that the closure may be screwed onto the container 22. As mentioned, a similar shoulder 96 may alternatively be formed in the recess 94 to catch on the lug 95 for the same purpose.

Figure 4:
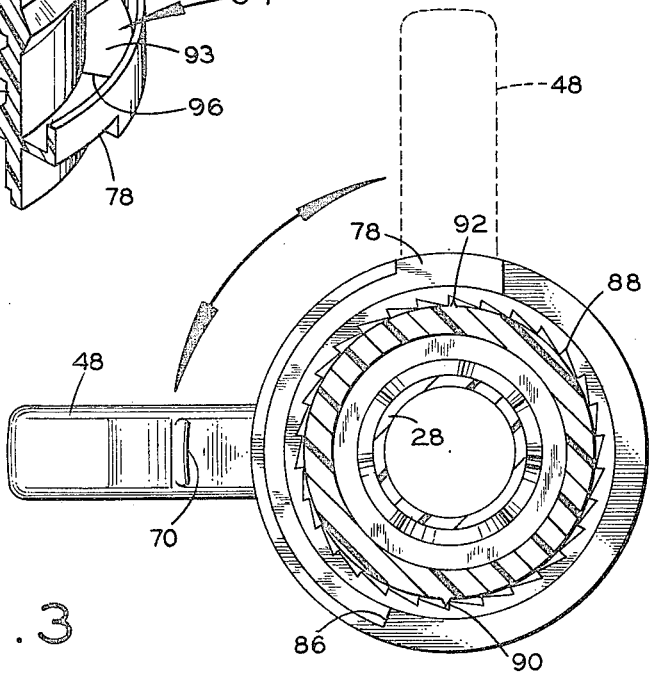
FIG. 4 is a horizontal sectional view taken along line 4—4 in FIG. 2.

The lower end of the wall 74 of the closure ring 32 is provided with ratchet teeth 88. As shown in FIGS. 4 and 10, the container 22 has mold parting lines with projecting flash at 90 and 92. The teeth 88 catch on this flashing at the mold parting lines to prevent the closure from being unscrewed from the container accidentally. Thus, the teeth constitute a unidirectional ratcheting device.

The illustrated parts are made of plastic.

I claim:

1. In a dispensing pump assembly for dispensing product from a container, a pivotally reciprocable lever for actuating said pump assembly;

said lever having a catch;

and locking means in said pump assembly for releasably engaging said catch to lock said lever in a depressed position;

said pump assembly including a closure and a housing rotatable on said closure;

and said locking means including a lip on said closure having a recess therein for receiving said catch;

said housing and lever being rotatable to align said lever with said recess, said lever being depressible to insert said catch in said recess, and said housing and lever being further rotatable to engage said inserted catch with said lip.

2. The pump assembly of claim 1 in which: said closure has a circular groove therein and said housing has a lug engageable with said circular groove.

3. In a dispensing pump assembly for dispensing product from a container, including:

pump means having piston and cylinder means for withdrawing product from the container and discharging product as a stream or spray;

said piston and cylinder means including a piston reciprocable in a cylinder and protruding upwardly therefrom;

a closure for the container affixed to said cylinder;

a housing over said piston and affixed to said closure;

and a lever engaging said piston for reciprocating said piston;

said lever being pivotally connected to said housing at one end thereof and having a trigger at the other end thereof projecting from said housing:

the improvement comprising:

said closure having an annular lip with a recess therein;

and said trigger having a catch thereon for engaging said lip to lock said trigger and said piston in a depressed position;

said housing and lever being rotatable on said closure to align said lever with said recess, said lever being depressible to insert said catch in said recess, and said housing and lever being further rotatable to engage said inserted catch with said lip.

4. The pump assembly of claim 3 in which:

said closure has a circular groove therein and said housing has a lug engageable with said circular groove.

5. The pump assembly of claim 3 in which:

said closure has a circular groove with a shoulder therein and said housing has a lug engageable with said shoulder in said circular groove.

6. The dispensing pump assembly of claim 3 in which:

said closure is a threaded ring having an annular, peripheral, radially projecting lip with a downturned edge;

said edge having said recess formed therein facing downwardly to permit entry of said catch;

and said lip having a shoulder for stopping said catch to stop the rotation of said housing and lever when said catch engages said lip.

* * * * *